US007438125B2

(12) United States Patent
Victor

(10) Patent No.: US 7,438,125 B2
(45) Date of Patent: Oct. 21, 2008

(54) VARIABLE ORIFICE BYPASS PLUNGER

(75) Inventor: Bruce M. Victor, Fort Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 114 days.

(21) Appl. No.: 11/110,447

(22) Filed: Apr. 20, 2005

(65) Prior Publication Data

US 2005/0241819 A1 Nov. 3, 2005

Related U.S. Application Data

(60) Provisional application No. 60/563,711, filed on Apr. 20, 2004.

(51) Int. Cl.
*E21B 43/12* (2006.01)
*E21B 27/00* (2006.01)

(52) U.S. Cl. ..... 166/68; 166/105.2; 166/110; 166/169

(58) Field of Classification Search ..... None
See application file for complete search history.

(56) References Cited

U.S. PATENT DOCUMENTS

| | | | | |
|---|---|---|---|---|
| 2,147,766 | A | 2/1939 | Coberly | 103/46 |
| 2,714,855 | A | 8/1955 | Brown | 103/52 |
| 3,181,470 | A | 5/1965 | Clingman | |
| 3,861,471 | A | 1/1975 | Douglas | |
| 4,502,843 | A | 3/1985 | Martin | 417/56 |
| 4,712,981 | A | 12/1987 | Gramling William D. | |
| 5,253,713 | A | 10/1993 | Gregg et al. | 166/372 |
| 5,333,684 | A | 8/1994 | Walter et al. | |
| 5,431,229 | A | 7/1995 | Christensen | |
| 6,148,923 | A | 11/2000 | Casey | 166/372 |
| 6,176,309 | B1 | 1/2001 | Bender | 166/68 |
| 6,273,690 | B1 | 8/2001 | Fischer, Jr. et al. | |
| 6,325,152 | B1 | 12/2001 | Kelley et al. | |
| 6,467,541 | B1 | 10/2002 | Wells | |
| 6,543,543 | B2 | 4/2003 | Muth | |
| 6,554,580 | B1 | 4/2003 | Mayfield et al. | |
| 6,591,737 | B2 | 7/2003 | Giacomino | 92/193 |
| 6,637,510 | B2 | 10/2003 | Lee | |
| 6,669,449 | B2 | 12/2003 | Giacomino | 417/56 |
| 6,705,404 | B2 | 3/2004 | Bosley | 166/372 |
| 6,725,916 | B2 | 4/2004 | Gray et al. | |
| 6,746,213 | B2 | 6/2004 | Giacomino | 417/56 |

(Continued)

FOREIGN PATENT DOCUMENTS

| | | |
|---|---|---|
| CA | 2 428 618 A1 | 11/2004 |
| RU | 2225502 | 3/2004 |

OTHER PUBLICATIONS

MGM Well Service, Inc., Pacemaker Plunger Co., P.O. Box, 270924, Corpus Christi, TX 78427-0924 Pacemaker Plunger Cariations internet marketing material, Feb. 12, 2003.

*Primary Examiner*—Zakiya W. Bates
(74) *Attorney, Agent, or Firm*—Aileen Law; A Law Firm, P.C.

(57) ABSTRACT

A plunger mechanism comprises an adjustable bypass valve. Depending on well parameters, a user may desire to adjust the descent rate of a plunger in service. The present device allows the user to vary or adjust the bypass orifice to alter the flow of liquid through the plunger core.

19 Claims, 8 Drawing Sheets

U.S. PATENT DOCUMENTS

| | | | | |
|---|---|---|---|---|
| 6,907,926 | B2 | 6/2005 | Bosley | 166/108 |
| 6,945,762 | B2 | 9/2005 | Williams | 417/546 |
| 2002/0162662 | A1 | 11/2002 | Passamaneck et al. | |
| 2003/0141051 | A1 | 7/2003 | Abbott et al. | |
| 2003/0155129 | A1 | 8/2003 | Gray et al. | |
| 2003/0215337 | A1 | 11/2003 | Lee | |
| 2004/0129428 | A1 | 7/2004 | Kelley | 166/372 |
| 2005/0194149 | A1 * | 9/2005 | Giaomino | 166/369 |

* cited by examiner

VARIABLE ORIFICE BYPASS PLUNGER

CROSS REFERENCE APPLICATIONS

This application is a non-provisional application claiming the benefits of provisional application Ser. No. 60/563,711 filed Apr. 20, 2004.

FIELD OF ART

The present apparatus relates to a plunger lift apparatus for the lifting of formation liquids in a hydrocarbon well. More specifically the plunger comprises a variable orifice in a bypass plunger apparatus that operates to allow a variation in plunger bypass capabilities as a function of well parameters.

BACKGROUND

A plunger lift is an apparatus that is used to increase the productivity of oil and gas wells. In the early stages of a well's life, liquid loading is usually not a problem. When rates are high, the well liquids are carried out of the well tubing by the high velocity gas. As a well declines, a critical velocity is reached below which the heavier liquids do not make it to the surface and start to fall back to the bottom exerting back pressure on the formation, thus loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also keeps the tubing free of paraffin, salt or scale build-up. A plunger lift system works by cycling a well open and closed. During the open time, a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

As the flow rate and pressures decline in a well, lifting efficiency declines geometrically. Before long the well begins to "load up". This is a condition whereby the gas being produced by the formation can no longer carry the liquid being produced to the surface. There are two reasons this occurs. First, as liquid comes in contact with the wall of the production string of tubing, friction occurs. The velocity of the liquid is slowed, and some of the liquid adheres to the tubing wall, creating a film of liquid on the tubing wall. This liquid does not reach the surface. Secondly, as the flow velocity continues to slow, the gas phase can no longer support liquid in either slug form or droplet form. This liquid along with the liquid film on the sides of the tubing begin to fall back to the bottom of the well. In a very aggravated situation, there will be liquid in the bottom of the well with only a small amount of gas being produced at the surface. The produced gas must bubble through the liquid at the bottom of the well and then flow to the surface. Because of the low velocity, very little liquid, if any, is carried to the surface by the gas. Thus, a plunger lift will act to remove the accumulated liquid.

A typical installation plunger lift system 100 can be seen in FIG. 1. Lubricator assembly 10 is one of the most important components of plunger system 100. Lubricator assembly 10 includes cap 1, integral top bumper spring 2, striking pad 3, and extracting rod 4. Extracting rod 4 may or may not be employed depending on the plunger type. Contained within lubricator assembly 10 is plunger auto catching device 5 and plunger sensing device 6. Sensing device 6 sends a signal to surface controller 15 upon plunger 200 arrival at the well top. Plunger 200 can represent the plunger of the present invention or other prior art plunges. Sensing the plunger is used as a programming input to achieve the desired well production, flow times and wellhead operating pressures.

Master valve 7 should be sized correctly for the tubing 9 and plunger 200. An incorrectly sized master valve 7 will not allow plunger 200 to pass through. Master valve 7 should incorporate a full bore opening equal to the tubing 9 size. An oversized valve will allows gas to bypass the plunger causing it to stall in the valve.

If the plunger is to be used in a well with relatively high formation pressures, care must be taken to balance tubing 9 size with the casing 8 size. The bottom of a well is typically equipped with a seating nipple/tubing stop 12. Spring standing valve/bottom hole bumper assembly 11 is located near the tubing bottom. The bumper spring is located above the standing valve and can be manufactured as an integral part of the standing valve or as a separate component of the plunger system. Fluid accumulating on top of plunger 200 may be carried to the well top by plunger 200.

Surface control equipment usually consists of motor valve(s) 14, sensors 6, pressure recorders 16, etc., and an electronic controller 15 which opens and closes the well at the surface. Well flow 'F' proceeds downstream when surface controller 15 opens well head flow valves. Controllers operate on time, or pressure, to open or close the surface valves based on operator-determined requirements for production. Modern electronic controllers incorporate features that are user friendly, easy to program, addressing the shortcomings of mechanical controllers and early electronic controllers. Additional features include: battery life extension through solar panel recharging, computer memory program retention in the event of battery failure and built-in lightning protection. For complex operating conditions, controllers can be purchased that have multiple valve capability to fully automate the production process.

Modern plungers are designed with various sidewall geometries (ref. FIG. 10) and can be generally described as follows:

A. Shifting ring plungers for continuous contact against the tubing to produce an effective seal with wiping action to ensure that all scale, salt and paraffin is removed from the tubing wall. Some designs have by-pass valves to permit fluid to flow through during the return trip to the bumper spring with the by-pass shutting when the plunger reaches the bottom. The by-pass feature optimizes plunger travel time in high liquid wells.

B. Pad plungers have spring-loaded interlocking pads in one or more sections. The pads expand and contract to compensate for any irregularities in the tubing, thus creating a tight friction seal. Pad plungers can also have a by-pass valve as described above.

C. Brush plungers incorporate a spiral-wound, flexible nylon brush section to create a seal and allow the plunger to travel despite the presence of sand, coal fines, tubing irregularities, etc. By-pass valves may also be incorporated.

D. Solid plunger have solid sidewall rings for durability. Solid sidewall rings can be made of various materials such as steel, poly materials, Teflon, stainless steel, etc. Once again, by-pass valves can be incorporated.

E. Snake plungers are flexible for coiled tubing and directional holes, and can be used as well in straight standard tubing.

Recent practices toward slim-hole wells that utilize coiled tubing also lend themselves to plunger systems. Because of the small tubing diameters, a relatively small amount of liquid may cause a well to load-up, or a relatively small amount of paraffin may plug the tubing.

Plungers use the volume of gas stored in the casing and the formation during the shut-in time to push the liquid load and plunger to the surface when the motor valve opens the well to the sales line or to the atmosphere. To operate a plunger installation, only the pressure and gas volume in the tubing/casing annulus is usually considered as the source of energy for bringing the liquid load and plunger to the surface.

The major forces acting on the cross-sectional area of the bottom of the plunger are:

- The pressure of the gas in the casing pushes up on the liquid load and the plunger.
- The sales line operating pressure and atmospheric pressure push down on the plunger.
- The weight of the liquid and the plunger weight push down on the plunger.
- Once the plunger begins moving to the surface, friction between the tubing and the liquid load acts to oppose the plunger.
- In addition, friction between the gas and tubing acts to slow the expansion of the gas.

In certain high liquid wells, fluid build up hampers the plunger's decent during the return trip to the bumper spring at the well bottom. Thus, wells with a high fluid level tend to lessen well production by delaying the cycle time of the plunger system, specifically delaying the plunger return trip to the well bottom. Prior art designs have utilized by-pass valves within plungers. These by-pass valves permit the fluid to flow through the plunger during the return trip to the bumper spring at the well bottom. The by-pass valve provides a shut off feature when the plunger reaches the bottom. This open by-pass feature allows a faster plunger travel time down the hole in high liquid wells. Although by-pass valves are manufactured to allow fluid pass through, optimization of the by-pass opening size for the valve is difficult due to variations in well liquid loading. As well conditions change, different by-pass openings are required for optimization. The prior art solution tends the use of a variety of bypass plungers, each with a different size orifice opening. Thus, the optimization of prior art plunger lifts in a high liquid well is difficult with a fixed size orifice by-pass design. When the plunger falls slowly to the bottom of the well, it decreases well efficiency. Plunger drop travel time slows or limits well production. Well production increases are always critical.

What is needed is a plunger lift apparatus whose orifice size can be tuned to well conditions at the well itself and whose orifice size can be quickly changed at the well site as well liquid loading conditions change over time. The invention must function in a high liquid well, be one that can insure continuous efficiency during lift, drop back to the well bottom quickly and easily and assist in increasing well production by increasing lift cycle times. The apparatus of the present invention provides a solution to these issues.

SUMMARY OF THE DISCLOSURE

One aspect of the present device is to provide a variable orifice by-pass plunger apparatus that can increase well production levels in a high liquid well.

Another aspect of the present device is to provide a by-pass plunger apparatus with a by-pass orifice that can be easily varied at the well itself to several different positions.

Another aspect of the present device is to provide a by-pass plunger that could efficiently force fall inside the tubing to the wellhole bottom with increased speed without impeding well production.

Another aspect of the present device is to allow for a by-pass valve to be shut once the plunger reaches the well bottom in order to provide for proper plunger return lift to the well top.

Yet another aspect of the present device is to allow for the plunger by-pass valve to be re-opened to its preset condition once the plunger reaches the well top.

Another aspect of the present device is to allow for various plunger sidewall geometries to be utilized.

Other aspects of this device will appear from the following description and appended claims, reference being made to the accompanying drawings forming a part of this specification wherein like reference characters designate corresponding parts in the several views.

The present device comprises a plunger lift apparatus having a top second with an inner diameter allowing for liquid by-pass, and a bottom second comprising a variable by-pass valve to allow fluid to flow through the valve and up through the top section during the return trip to the bumper spring at the well bottom. The device typically comprises an inside top hollow orifice design (typically a standard American Petroleum Institute fishing neck).

The variable orifice by-pass plunger (VOBP) allows more than one orifice setting in the by-pass valve. Depending on the high liquid well parameters, the VOV can be set to optimize the VOBP return time to the well bottom, thus optimizing the production efficiency of the well.

The VOBP comprises a variable orifice valve (VOV) that has a variable orifice that can easily be set to more than one position. When released from an auto catcher, an orifice functions to allow liquid to pass through the plunger's lower valve section and up through the plunger's top second during its trip to the well bottom. The well control system will release the plunger to fall in the well when conditions are satisfied. Once at the well bottom, the lower valve section is designed to shut off the by-pass feature when striking the aforementioned bumper spring. Upon its trip to the well top, the aforementioned extracting rod within the lubricator will cause the device's valve section to re-open at its predetermined set condition.

The present device helps to assure an efficient lift in a high liquid well due to its design. The present device can also optimize well efficiency due to the fact that it has a field-adjustable orifice to allow it to quickly travel to the well bottom.

Figure 1:
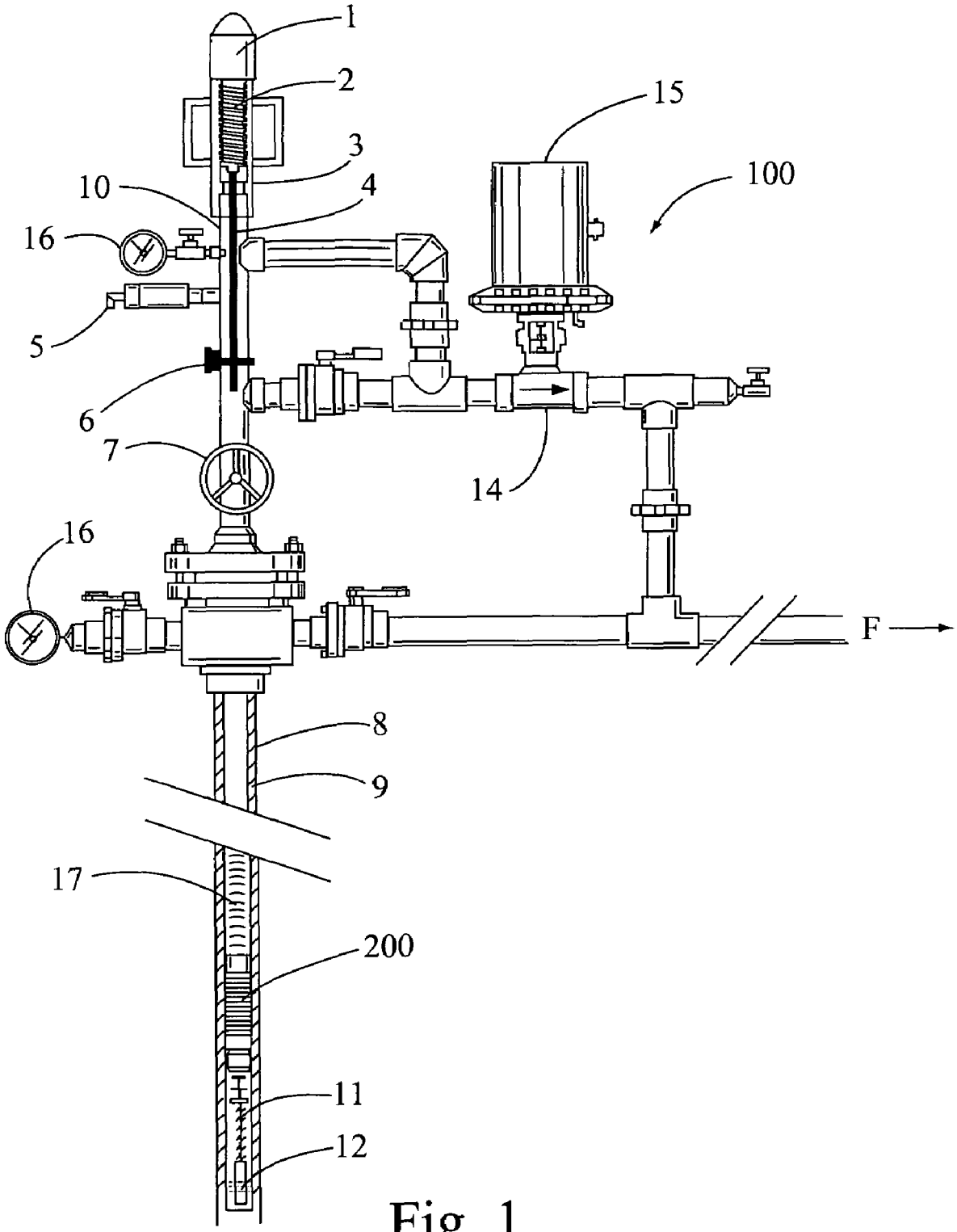
Fig. 1 (PRIOR ART)
FIG. 1 (prior art) is an overview depiction of a typical plunger lift system installation.

Before explaining the disclosed embodiment in detail, it is to be understood that the device is not limited in its application to the details of the particular arrangement shown, since the device is capable of other embodiments. Also, the terminology used herein is for the purpose of description and not of limitation.

DETAILED DESCRIPTION OF THE DRAWINGS

Referring now to the drawings, the disclosed device provides a variable orifice by-pass plunger (VOBP) (see item 1000 of FIG. 11) that may help increase well production levels in a high liquid well. The VOBP comprises a lower section variable orifice valve (VOV) 200 (see FIGS. 2, 3, 4, 10) that can be easily preset to several different levels. One embodiment comprises three set levels. The VOBP is designed to be set to an optimized by-pass orifice opening to efficiently force fall through liquid inside the tubing to the well-hole bottom. Adjustment of the orifice setting seeks to alter return speed through liquid and thus optimize well production. VOV 200 comprises an internal by-pass shut off mechanism, which will close the by-pass feature once the plunger reaches the well bottom. A shut off condition provides for proper plunger return lift to the well top. The plunger by-pass valve will be re-opened to its preset condition once the plunger reaches the well top.

Figure 10:
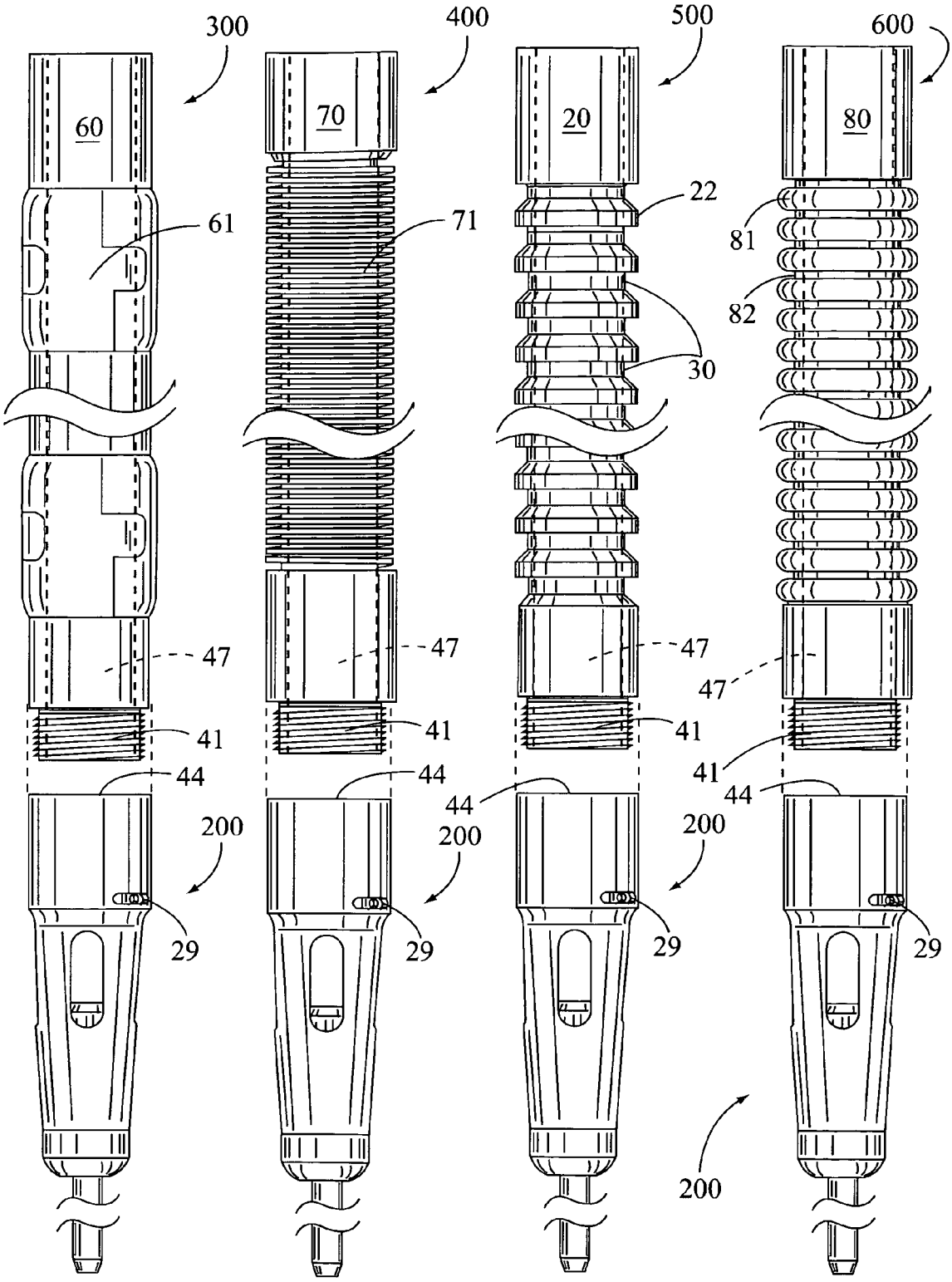
FIG. 10 shows side plan views of the disclosed device with various sidewall geometries.

The top second of a VOBP can be designed using various aforementioned plunger sidewall geometries (ref. FIG. 10, items 20, 60, 70, 80) each comprising a hollowed out core 47. As shown, the top collar of each VOBP illustrated is designed with a standard American Petroleum Institute (API) internal fishing neck. Fish necks are a well-known industrial design offering and are therefore not shown in detail herein. In operation, a spring loaded ball within a retriever and protruding outside the retriever's surface falls within the API internal fishing neck if retrieval is necessary.

The bottom section, or variable orifice valve (VOV) 200, attaches to the VOBP top section. VOV 200 comprises a variable by-pass orifice to allow fluid to flow through the VOV and up through the top section during the plunger's trip to the bumper spring at the well bottom.

Figure 11:
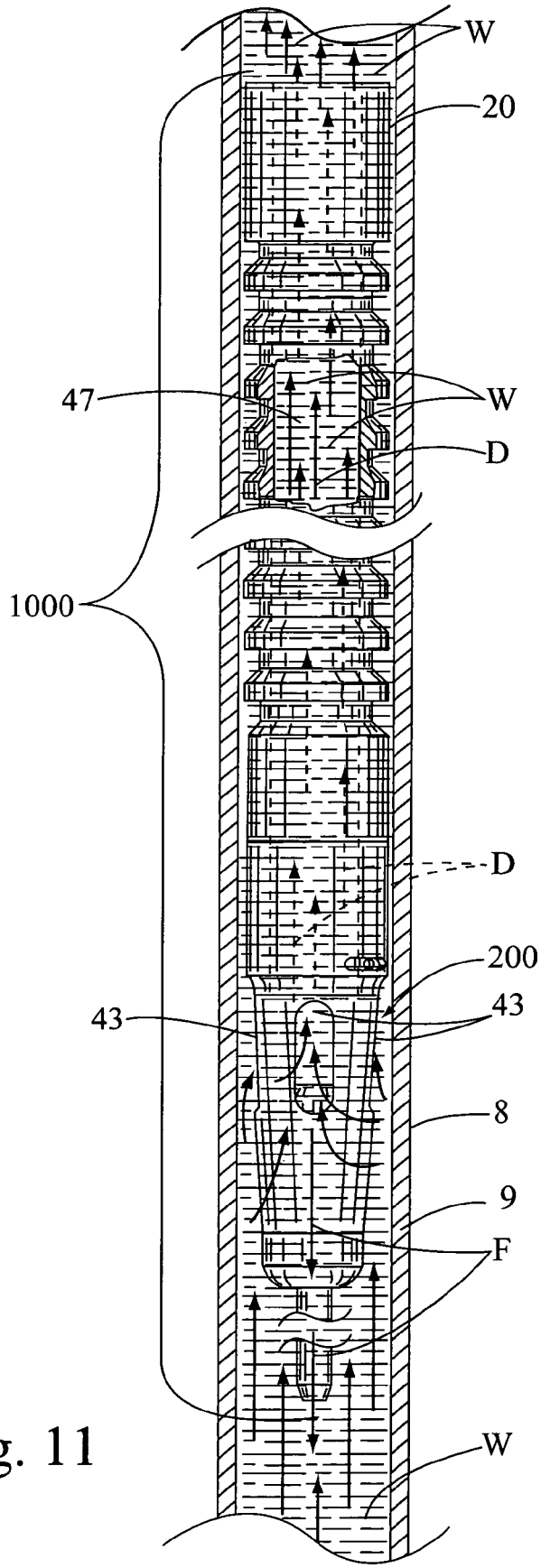
FIG. 11 is a side plan view of the disclosed device falling through liquid within the well tubing.

The disclosed device allows more than one orifice opening setting within VOV 200. That is, the variable orifice can easily be set to one or more positions. When released from the auto catcher, the orifice will function to allow liquid W (ref. FIG. 11) to pass through the lower section (VOV 200) and up through hollowed out core 47 (see FIGS. 10, 11) during its trip to the well bottom. The well control system will release the VOBP to fall into the well when conditions are satisfied. Depending on well parameters, VOV 200 can be set to optimize the plunger's travel time to the well bottom, thus optimizing the production efficiency of the well. Once at the well bottom, the VOV is designed to strike the aforementioned bumper spring and close. Upon its trip to the well top, the aforementioned extracting rod within the lubricator will cause VOV 200 to reopen at its predetermined set condition.

The disclosed device comprises an adjustable orifice to allow it to quickly travel to the well bottom. The orifice is thus field adjustable; it can be tuned at the well site depending on well parameters to optimize well cycle times. The higher the well pressure and/or liquid loading, the greater the orifice opening can be set. This results in the ability to optimize the bypass settings based on well conditions allowing the VOBP to fall to the bottom in an optimal manner. This avoids having to have a variety of different bypass valves, with various manufactured orifice openings, at the well site. The VOBP disclosed herein provides for the ability to field-adjust the bypass settings as well parameters change over time.

Figure 4A:
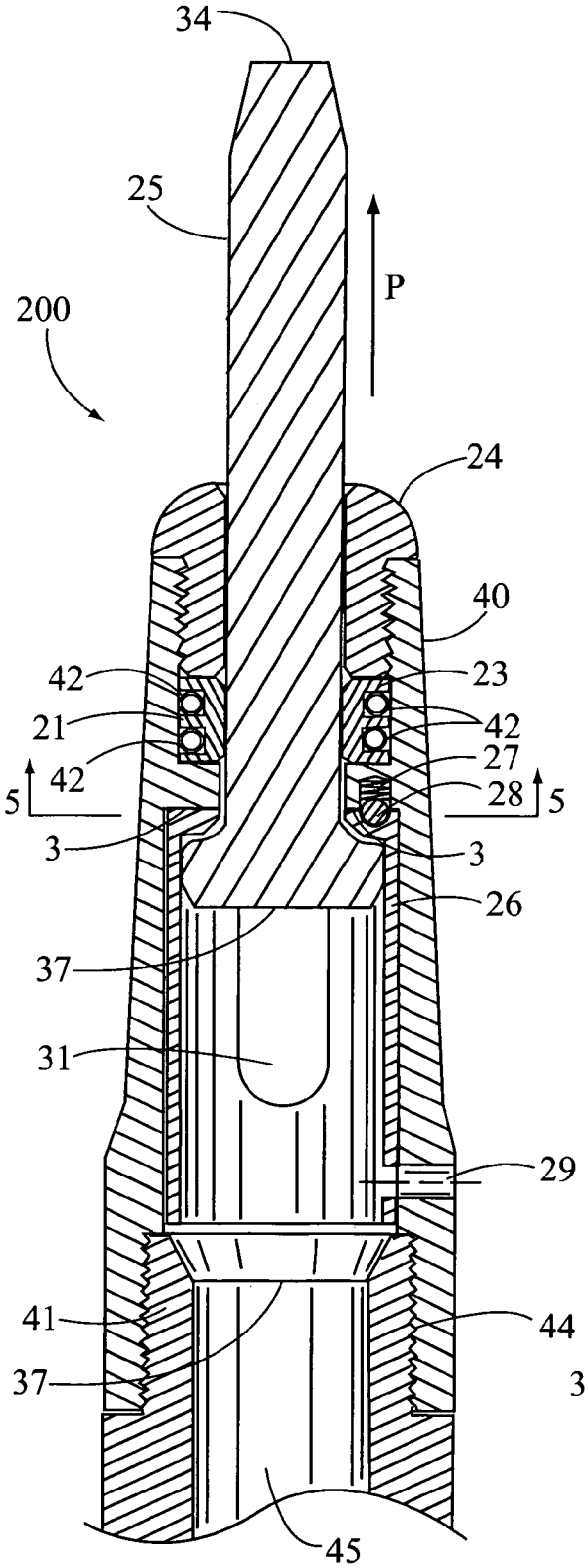
FIG. 4A is a side cross-sectional view of the disclosed device shown in an open (or bypass) position.
Figure 4B:
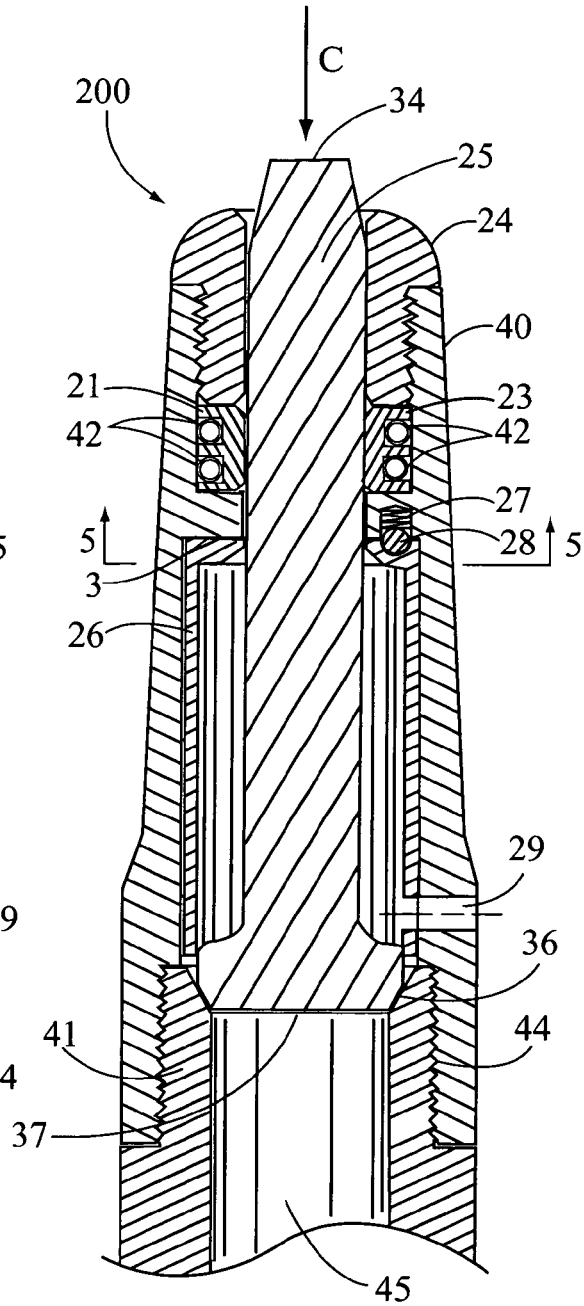
FIG. 4B is a side cross-sectional view of the disclosed device shown in a closed (no bypass) position.
Figure 7:
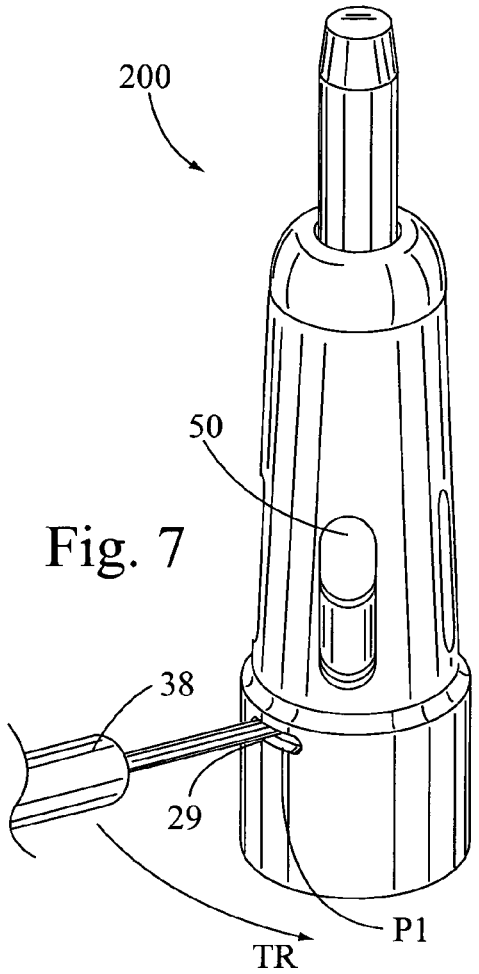
FIGS. 7, 8, 9 are side perspective drawings of the disclosed device showing the adjustment of the device to three set-points.
Figure 8:
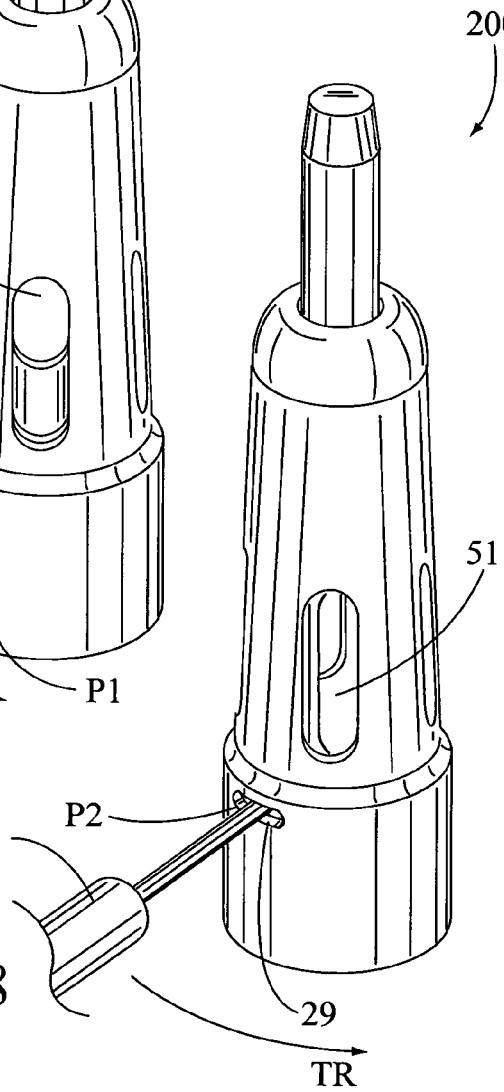
Figure 9:
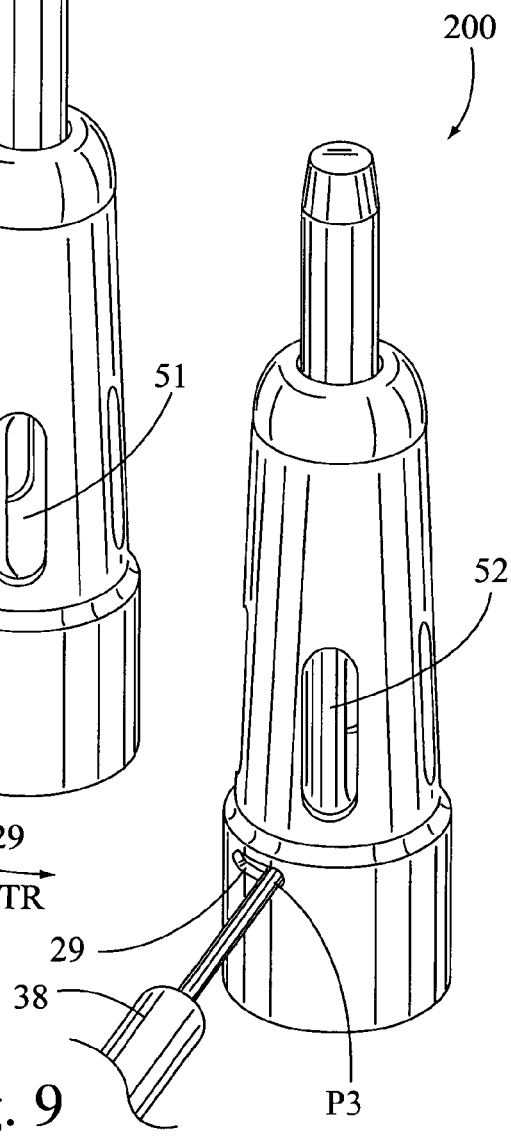

The VOBP may be employed as follows:

1. The bypass setting is manually tuned for well loading conditions (ref. FIGS. 7, 8, 9).
2. The VOBP is at the bottom of a well with liquid loading on top of the plunger and with its push rod 25 set in a closed bypass position (ref. FIG. 4B).
3. The well is open for flow at which time the VOBP rises towards the well top to carry accumulated liquids out of the well bore.
4. The VOBP reaches the well top, is caught within the lubricator, and the extracting rod (ref. FIG. 1) strikes push rod 25 to move it into a bypass (or open) position (ref. FIG. 4A).
5. The well flows for a set time or condition controlled by the well-head controller.
6. The auto-catcher releases the VOBP after a set time or condition as controlled by the well system controller.
7. The VOBP force falls to the well bottom, its bypass setting allowing liquid enter its bypass opening and regulate its fall to the well bottom.
8. The well plunger lift cycle starts again (step 2 above).
9. Periodically, an operator visits the well site and decides whether or not to change the bypass setting for sizing the flow through orifice, depending on the well liquid loading parameters.

Figure 2:
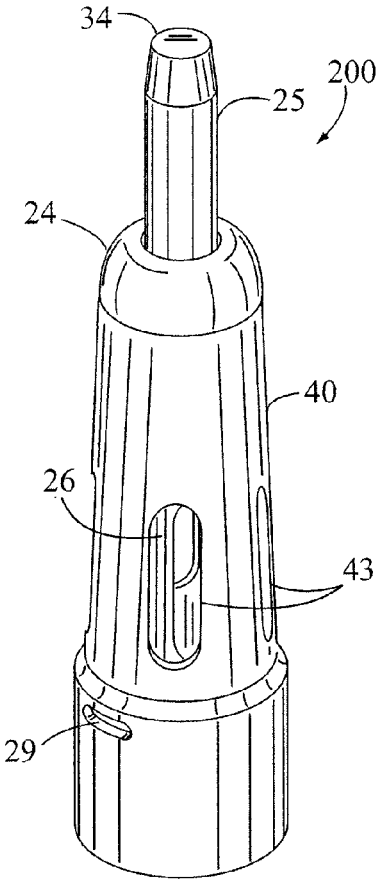
FIG. 2 is a side perspective view of the variable orifice valve (VOV) of the disclosed device.

FIG. 2 is a side perspective view of VOV 200. VOV 200 is located at the bottom section of the VOBP. When the VOBP falls to the well bottom, push rod 25 bottom surface 34 will strike the aforementioned well bottom bumper spring causing push rod 25 to move up into VOV 200 and close the bypass function (ref. FIG. 4B). VOV 200 is shown with VOV body cylinder 40 having VOV body cylinder orifice 43 set to one-third open due to the position of variable control cylinder 26. The positioning of variable control cylinder 26 can be adjusted through adjustment slot 29. VOV bottom cap 24 functions to contain all internal parts of VOV 200.

Figure 12:
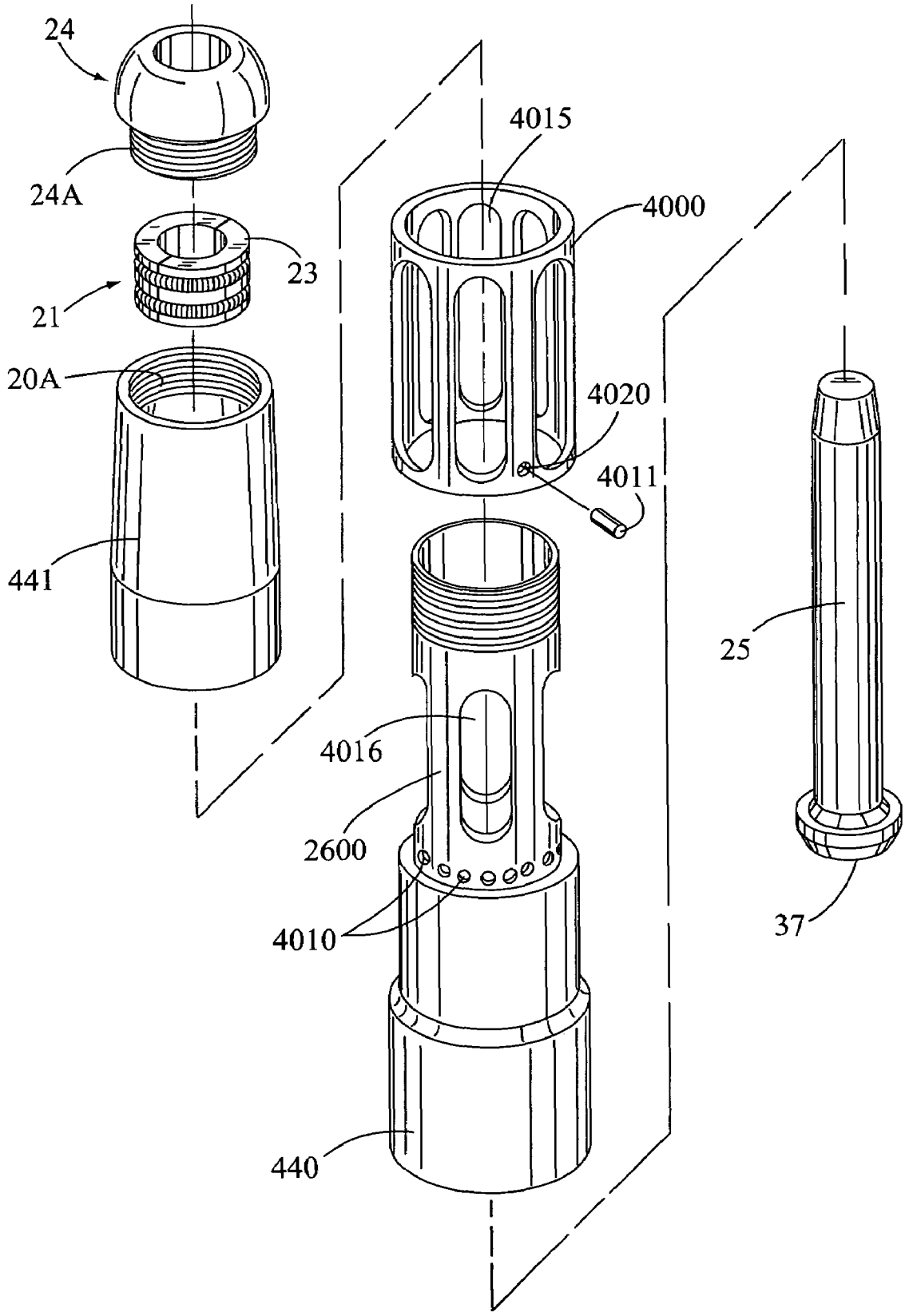
FIG. 12 is an exploded view of an alternate embodiment.

A drawing of an alternate embodiment (FIG. 12) shows the upper body end 440 securing the control cylinder 2600 in a fixed position. The VOV body cylinder 4000 rotates around the upper body end 440. Threads could provide this rotation, cylinder pins 4011 could mount in holes 4010 in the body end 440, or other design choices could be used. The slots 4015 are ajustably aligned with slots 4016 to provide a variable orifice. Hole 4020 can be aligned with a chosen hole 4010 to set the orifice. Sheath 441 secures the cylinder 4000 to the upper body end 440.

Figure 3:
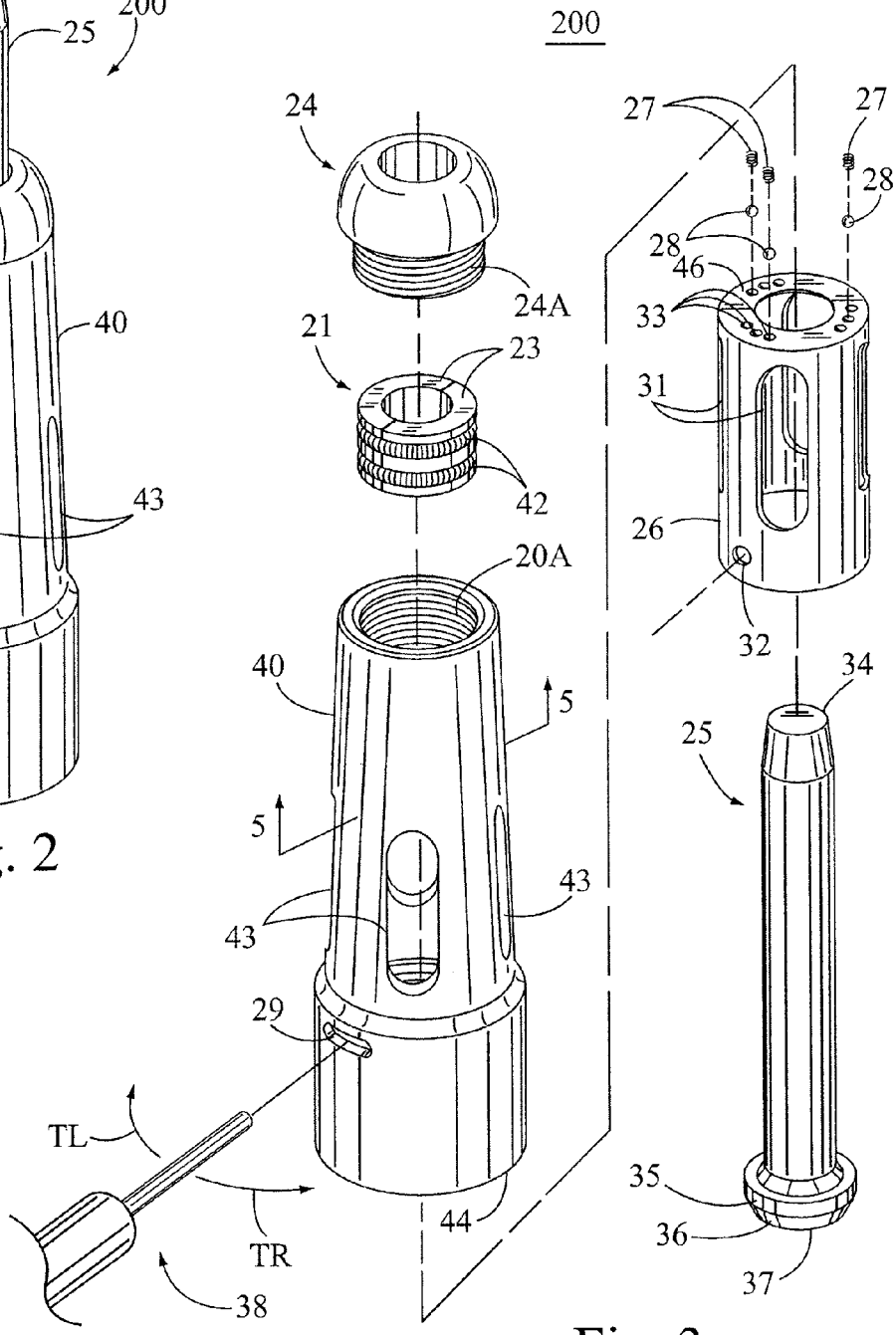
FIG. 3 is a side perspective exploded view of the device shown in FIG. 2.
Figure 5:
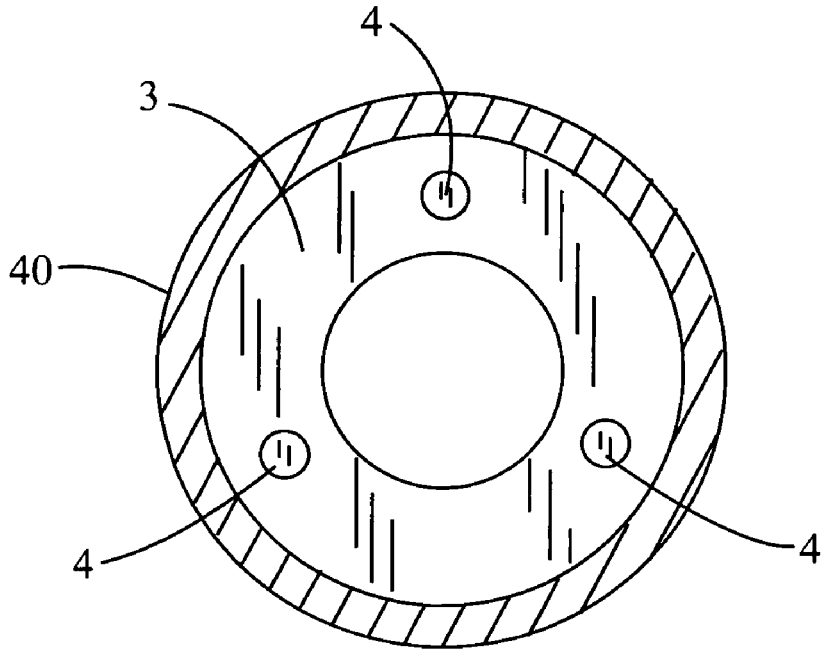
FIG. 5 is a top cross sectional view of the FIG. 2 embodiment showing the three ball and spring fixed locations.
Figure 6:
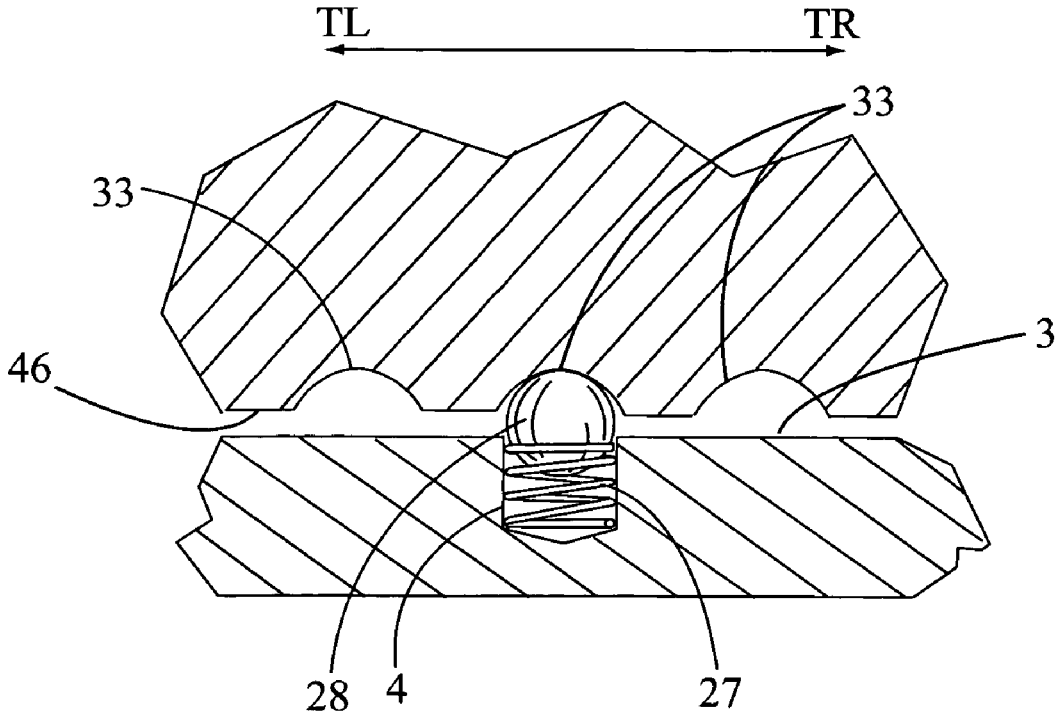
FIG. 6 is a blow up view of a portion of FIGS. 4A, 4B illustrating a ball and spring combination ratcheted (or set) in a middle location.

FIG. 3 is a side perspective exploded view of VOV 200. VOV body cylinder 40 is designed to have an adjustment slot 29 for orifice adjustment access. Adjustment slot 29 provides tool 38 with access to control cylinder adjustment hole 32. Four VOV body cylinder orifices 43 are shown spaced at about 90° apart. Internal threaded lower body end 20A accepts VOV bottom cap 24. VOV bottom cap 24 comprises external threaded area 24A mateable with VOV body cylinder internal threaded lower body end 20A. Internal wall 3 (ref. FIGS. 5, 6) can comprise three springs 27 and three corresponding balls 28 all with a fixed position and separated by about 120°. Internal threaded upper body end 44 mates with threaded end 41 (see FIG. 10) of a plunger.

Push rod brake clutch 21 comprises two half cylinders 23 each containing annular grooves to contain annular push rod brake clutch springs 23 and functioning to contain push rod 25 in either its open or closed positions. Bottom bumper striker end 34 can move push rod 25 into a closed position once VOBP hits the well bottom. Push rod closure end 37, outer closure ring 35 and rod slant surface 36 function to both close against VOBP top second at the well bottom and also to move to an open position when VOBP lifts to the well top. The striker rod within the lubricator (not shown) will strike against rod top end 37 to move push rod 25 into its open position thus allowing the VOBP to bypass fluids on its travel to the well bottom.

Variable control cylinder 26 comprises external adjustment hole 32 and four control cylinder orifices 31 which are spaced apart by about 90°. Variable control cylinder top source 46 shows nine preset position control half globe holes 33 located in groups of three, each group about 120° apart and each half globeholes within a group at about 20° apart. Control half globe holes 33 mate with balls 28 three at a time providing three preset through-orifice positions (full open, one-third open, two thirds open) in each of the four through orifices. The total opening, or through-orifice is a function of the position of the control cylinder orifices 31 with respect to the VOV body cylinder orifices 43.

When VOV 200 is assembled, control cylinder orifices 31 align with VOV main body cylinder orifices 43 such that the total through opening will be about 33%, 67%, or 100% depending on the positioning of variable control cylinder 26 in one of its three set positions. Adjustment slot 29 provides external tool 38 right movement direction TR or left movement direction TL functioning to set variable control cylinder 26 in one of its three positions via control cylinder adjustment control hole 32. VOV 200 is geometrically designed to have a fluid/gas dynamic type shape to allow it to quickly pass to the well bottom while allowing fluids to enter its orifice and pass through the top bored out section of the VOBP. Thus the VOBP will travel to the bottom with an efficient speed until it comes to rest on the bottom sitting or on a bumper spring, which will strike its push rod and close its bypass function.

FIG. 4A is a side cross-sectional view of VOV 200 showing push rod 25 in the open (or bypass) position. Threaded upper body end 44 mates with threaded end 41 (ref. FIG. 10). When VOV 200 arrives at the well top, the aforementioned striker rod within the lubricator hits push rod 25 at rod top end 37 moving push rod 25 in direction P to its open position. In its open position, the top end of push rod 25 rests against variable control cylinder 26 internal surface. Brake clutch 21 will hold push rod 25 in its open position allowing well loading (gas/fluids etc.) to enter the open orifice and move up through top second center bore 45.

FIG. 4B is a side cross-sectional view of VOV 200 with push rod 25 depicted in its closed (no bypass) position. When bottom bumper spring striker end 34 hits the aforementioned bumper spring at the well bottom, push rod 25 moves in direction C to a closed position as shown. In the closed position, rod top end 37 with its slant surface 36 closes against threaded top section end 44 and is held in the closed position by brake clutch 21.

FIG. 5 is a top cross-sectional view of (ref. section 5-5 of FIGS. 3, 4A, 4B) VOV body cylinder 40 showing three ball and spring fixed locations. Three ball springs 27 and three balls 28 (ref. FIG. 3) are located within bored out holes 4 spaced in an annular position around inner wall 3 and about 120° apart.

FIG. 6 is a blow up view showing inner variable control cylinder top surface 46 rarcheted (or set) in a middle orifice bypass set location. That is, of the possible three preset control half holes 33 within variable control cylinder top surface 46 locations, the through orifice is set to the mid bypass location. Thus shown is one of the three ball springs 27, and ball 28 located within one of the fixed internal set holes 4. Movement of variable control cylinder 26 (ref. FIG. 3) is in either direction TR or TL, which ratchets and fixes the bypass total through-orifice opening to a set location.

FIGS. 7, 8, 9 are side perspective drawings of VOV 200 showing the adjustment of the device to three possible VOV locations of the preferred embodiment. FIG. 7 depicts external tool 38 within adjustment slot 29 and in leftmost position P1. In position P1, variable control cylinder orifice is aligned with the VOV body cylinder orifice such that the through orifice is in fully open position 50. FIG. 8 depicts movement of external tool 38 in direction TR to mid-point P2 setting. In this mid-point P2 setting, the through orifice is now at two-thirds open position 51. FIG. 9 depicts further movement of external tool 38 in direction TR to its rightmost position P3, which has the through orifice in its one-third open position.

FIG. 10 shows side views of various VOBPs each utilizing a different sidewall geometry. Each VOBP is depicted in an unassembled state with respect to its unique sidewall geometry top section and a common VOV 200 bottom section. Each top section typically employs a standard API internal fishing neck. Each top section also has hollowed out core 47. Each bottom section shown depicts VOV 200 shown in its full open (or full bypass) set position. Each VOV 200 has internal threaded end 44, which accepts top second threaded end 41 to unite both sections. Shown in FIG. 10 are VOBPs with the following geometries:

a) VOBP 300 with top second 60 having spring-loaded interlocking pads 61 in one or more sections. The pads expand and contract to compensate for any irregularities in the tubing thus creating a tight friction seal.
b) VOBP 400 having top section 70 with brush sidewall 71 which is a spiral-wound, flexible nylon brush section to create a seal and allow the VOBP 400 to travel despite the presence of sand, coal fined, tubing irregularities, etc
c) VOBP 500 having top section 20 with solid sidewall rings 22 and cut grooves 30 for durability. Solid sidewall rings can be made of various materials such as steel, poly materials, Teflon®, stainless steel, etc.
d) VOVP 600 having top section 80 with shifting rings 81 individually separated at each upper surface and lower surface by air gap 82 for continuous contact against the tubing to produce an effective seal with wiping action to ensure that all scale, salt or paraffin is removed from the tubing wall.

FIG. 11 is a side plan view of VOBP 1000 falling, in direction F, through liquid W within the well tubing 9. VOBP 1000 is shown fully assembled with a solid sidewall top section 20 (ref. FIG. 10) and bottom section VOV 200 (ref. FIGS. 2, 3, 4) that is set in to a full open position. Liquid W enters VOV body cylinder orifice 43, moves up through hollowed out core 47 in direction D and out through VOBP 1000 top section 20. VOBP 1000 thus moves through liquid within well tubing 9 and outer casing 8 in an efficient manner with VOV body orifice 43 set to an optimum opening position.

The disclosed device allows for initial bypass tuning at the well site, allows future resets if necessary within one single plunger, and thus can assure well production optimization in high liquid gas wells.

It should be noted that although the hardware aspects of the VOV and VOBP of the present invention have been described with reference to the exemplary embodiment above, other alternate embodiments of the present invention could be easily employed by one skilled in the art to accomplish the variable bypass aspect of the present invention. For example, it will be understood that additions, deletions, and changes may be made to the variable orifice valve (VOV) with respect to design, adjustment mechanisms to set the orifice openings (such as ratchet type adjustments etc.), various orifice opening settings, orifice geometric design other than those described above, and various internal part designs contained therein.

Although the disclosed device has been described with reference to preferred embodiments, numerous modifications and variations can be made and still the result will come within the scope of the disclosure. No limitation with respect to the specific embodiments disclosed herein is intended or should be inferred.

I claim:

1. A variable orifice bypass plunger comprising:

a cylindrical body having an upper end, a lower end, and an internal channel therethrough, said internal channel capable of passing a fluid from said upper end;

said lower end connectable to valve assembly comprising a push rod positionable in an open and a closed bypass mode;

said valve assembly further comprising a variably sized or adjustable inlet, said inlet in communication with said internal channel; and wherein said valve assembly further comprises an outer body having an inlet hole and a rotatable control cylinder mounted therein, said rotatable control cylinder having a hole in a closure wall, wherein a rotation of said rotatable control cylinder adjusts said holes of said outer body and said rotatable control cylinder in relation to one another.

2. The plunger of claim 1, wherein said valve assembly is threadably connectable to said lower end.

3. The plunger of claim 1, wherein said rotatable control cylinder further comprises a top surface having engagement holes capable of receiving spring loaded engagement means to set said rotatable control cylinder at a desired rotation.

4. The plunger of claim 3, wherein said control cylinder further comprises a tool hole capable of receiving a tool to adjust said control cylinder.

5. The plunger of claim 4, wherein said outer body further comprises a slot capable of receiving said tool and a push rod clutch brake assembly capable of holding said push rod in either its open or its closed mode.

6. The plunger of claim 3, wherein said spring loaded engagement means further comprises a spring and a ball, said spring and ball capable of being received in a recess in said outer body.

7. An internal bypass plunger comprising:

a plunger body having an internal conduit with an inlet at its bottom and an outlet at its top;

said plunger bottom comprising a push rod movable from an extended position which leaves said inlet open, to a retracted position which closes said inlet;

said plunger bottom further comprising a side opening and a rotatable cage mounted inside, said cage comprising ahole aligned with said side opening;

wherein a change in the alignment of said side opening and said cage hole varies said inlet; and wherein said rotatable cage further comprises a releasable lock assembly to maintain a rotated position until a user changes it.

8. The plunger of claim 7, wherein said push rod comprises a clutch assembly capable of maintaining said push rod in a set position.

9. The plunger of claim 7, wherein said releasable lock assembly further comprises a recess in said plunger bottom capable of receiving a spring and a ball, said ball lockable into a recess in said cage.

10. The plunger of claim 7, wherein said cage further comprises an adjustment hole capable of receiving a tool.

11. The plunger of claim 10, wherein said plunger bottom further comprises a slot capable of receiving said tool.

12. A variable bypass plunger comprising:

a plunger body having a fluid channel and an inlet thereto at its bottom;

a variable bypass assembly connectable to said bottom;

said variable bypass assembly comprising a rotatable casing with a side hole;

wherein an internal fixed cage comprises a side hole alignable with said casing side hole to provide a variable orifice in fluid communication with said bottom inlet; and wherein a push rod is mountable in said variable bypass assembly to open and close said bottom inlet.

13. A variable orifice valve adapted to connect to an internal bypass plunger, said valve comprising:

an upper neck having a threaded connection for a plunger bottom;

said valve having a lower end with a clutch brake for a centrally mounted push rod;

said push rod having an upper valve head to seal an outlet of said upper neck in a retracted position, and open said outlet in an extended position;

said valve having an external housing with an inlet hole;

a rotatable cage mountable in said external housing; and wherein a hole in said cage is moveable in relation to said external housing inlet hole to provide a variable orifice for said outlet.

14. The valve of claim 13, wherein said cage comprises a lock to temporarily set said cage in a desired position until a user changes the position.

15. The valve of claim 14, wherein said cage comprises an adjustment hole for a tool, and said external housing comprises a slot to receive said tool.

16. The valve of claim 15, wherein said lock further comprises a recess in said external housing, said recess capable of receiving a spring and a ball, said ball slidingly engageable-with a recess in said cage.

17. A variable orifice valve for an internal bypass plunger, the apparatus comprising:

a housing capable of providing a connection at its upper end to a lower end of a plunger;

said housing having a lower end comprising a clutch to support a push rod in a set position;

said push rod capable of opening and closing said upper end; and a cage means mountable in said housing, said cage means capable of rotation to a desired position so as to align a cage hole with a housing hole, thereby providing a variable orifice to said upper end.

18. The apparatus of claim 17, wherein said cage means comprises a spring loaded catch capable of engaging a portion of said housing, said catch capable of temporarily setting said cage means at a position until a user changes said position.

19. The apparatus of claim 18, wherein the cage means comprises an adjustment hole to receive a tool for rotational adjustment.

* * * * *